US006525693B2

(12) United States Patent
Ugge'

(10) Patent No.: US 6,525,693 B2
(45) Date of Patent: Feb. 25, 2003

(54) DEVICE FOR THE RECEPTION OF GPS POSITION SIGNALS

(75) Inventor: Alessandro Ugge', Cambiano (IT)

(73) Assignee: Fiat Auto S.P.A.

( * ) Notice: Subject to any disclaimer, the term of this patent is extended or adjusted under 35 U.S.C. 154(b) by 0 days.

(21) Appl. No.: 09/970,805

(22) Filed: Oct. 5, 2001

(65) Prior Publication Data

US 2002/0041257 A1 Apr. 11, 2002

(30) Foreign Application Priority Data

Oct. 10, 2000 (IT) ..... TO00A0945

(51) Int. Cl.[7] ..... H01Q 1/32
(52) U.S. Cl. ..... 343/713; 343/711; 343/895
(58) Field of Search ..... 343/711, 712, 343/713, 895; H01Q 1/32, 1/36

(56) References Cited

U.S. PATENT DOCUMENTS 5,191,352 A * 3/1993 Branson ..... 343/895
5,854,608 A 12/1998 Leisten ..... 343/895
6,002,377 A * 12/1999 Huynh et al. ..... 343/895
6,019,475 A * 2/2000 Lynam et al. ..... 359/879
6,078,294 A 6/2000 Mitarai ..... 343/895
6,184,845 B1 * 2/2002 Leisten et al. ..... 343/895
6,384,798 B1 * 5/2002 Barta et al. ..... 343/895
6,246,379 B1 * 6/2002 Josypenko ..... 343/895
6,259,412 B1 * 7/2002 Duroux ..... 343/713

FOREIGN PATENT DOCUMENTS

| | | |
|---|---|---|
| EP | 0 865 100 A2 | 9/1998 |
| WO | WO 97/32355 | 9/1997 |
| WO | WO 97/37401 | 10/1997 |
| WO | WO 98/36469 | 8/1998 |
| WO | WO 99/56344 | 11/1999 |

* cited by examiner

*Primary Examiner*—Tho Phan
(74) *Attorney, Agent, or Firm*—Sughrue Mion, PLLC

(57) ABSTRACT

The device comprises an antenna mounted within an external rear view mirror of the motor vehicle. This antenna is a helical antenna preferably a four-wire helical antenna.

19 Claims, 7 Drawing Sheets

DEVICE FOR THE RECEPTION OF GPS POSITION SIGNALS

BACKGROUND OF THE INVENTION

The present invention relates to a device for reception of GPS (Global Positioning System) position signals on board a motor vehicle.

The installation of GPS position signal receiver devices on board motor vehicles is becoming widely diffused in recent times.

Such reception devices typically include microstrip antennae, which are essentially bi-dimensional. Such microstrip antennae are usually installed on the windscreen or the instrument panel of the motor vehicle.

The installation of microstrip antennae on a windscreen is inconvenient on motor vehicles having a strongly inclined windscreen. Such inclination in fact results in a loss of gain in reception.

The installation of microstrip antennae on the instrument panel can present disadvantages such as a reduction in gain, and therefore of the useful signal level when the vehicle is travelling down a hill, this gain loss being due to the screening effect of the roof of the passenger compartment.

SUMMARY OF THE INVENTION

One object of the present invention is therefore to provide a new device for the reception of GPS position signals on board a motor vehicle which makes it possible to obviate the above-indicated disadvantages of prior art arrangements.

A further object of the invention is to suggest the use, for the reception of GPS position signals, of a new and convenient type of antenna.

It is a further object of the invention to propose convenient embodiments of such an antenna.

These and other objects are achieved according to the invention with the device the characteristics of which are defined in the following claims.

BRIEF DESCRIPTION OF THE DRAWINGS

Further characteristics and advantages of the invention will become apparent from the following detailed description given solely by way of non-limitative example, with reference to the attached drawings, in which.

DETAILED DESCRIPTION OF THE INVENTION

Figure 1:
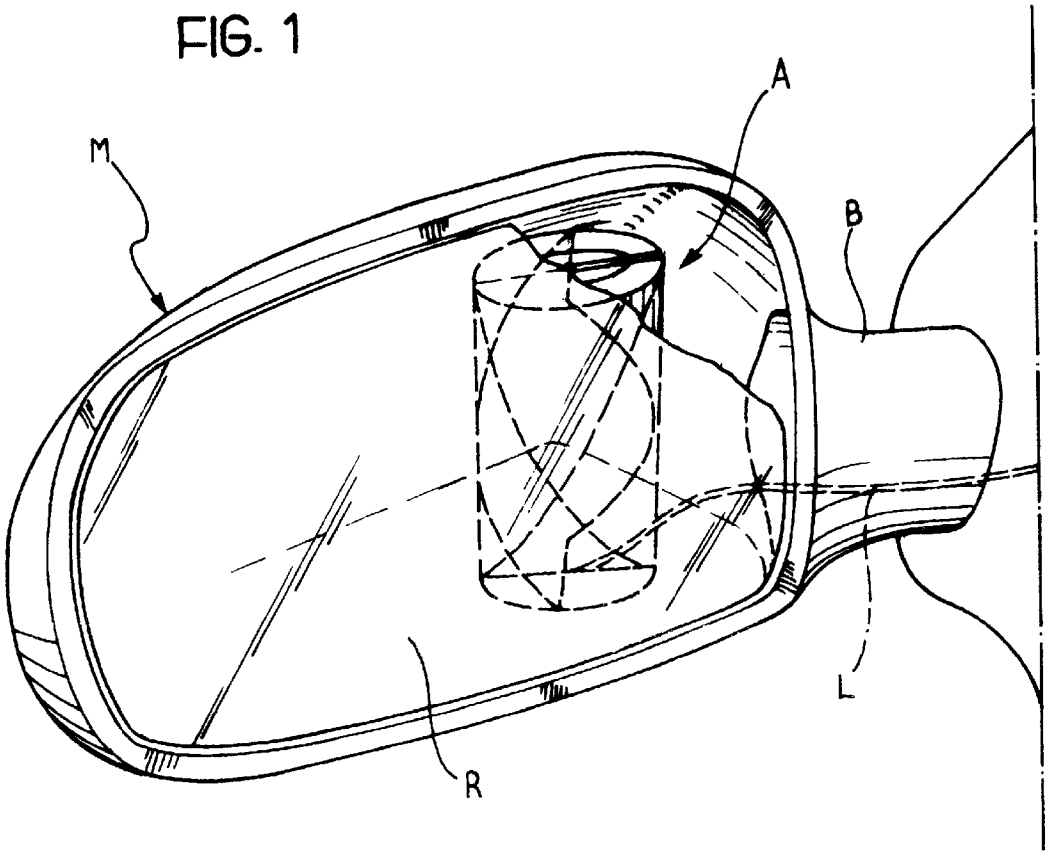
FIG. 1 is a partially sectioned perspective view of a device according to the invention for the reception of GPS position signals on board a motor vehicle.

With reference to FIG. 1, a device for the reception of GPS position signals on board a motor vehicle comprises an antenna A mounted within an external rear view mirror M of a motor vehicle (not illustrated).

The antenna A is conveniently a helical antenna, and in particular a four-wire helical antenna. Several specific embodiments of such an antenna will be described in greater detail hereinbelow.

Such an antenna has an essentially cylindrical general shape with a height or length the values of which fall within about one-quarter of a wavelength. The GPS position system utilises signals having a frequency close to 1.5 GHz, and the antenna A therefore has a height the value of which is around 5 cm. This height makes the antenna A suitable to be mounted within an external rear view mirror of the motor vehicle as is shown in FIG. 1, behind the reflecting element R.

The connection of the antenna A to detector, amplification, decoding and treatment circuits is achievable by means of a line L, for example a co-axial cable, which conveniently extends into the arm B of the mirror M.

The location of the antenna A in an external rear view mirror M has a number of advantages. In the first place, the antenna A is not subject appreciably to the screening effect exerted in certain conditions by the roof of the passenger compartment.

The use of a helical antenna and in particular of a four-wire helical antenna is furthermore extremely advantageous in that such antenna has a diagram which is essentially a cardioid of rotation, and has good reception characteristics in the upper hemisphere, without requiring any ground plane.

Four-wire helical antennae have until now predominantly found use as antennae for satellites (see, for example, AMSAT Newsletter, March 1975).

As will be more clearly explained hereinbelow, the four-wire helical antenna for use according to the invention preferably includes two half-turn twin wire helical loops, disposed at 90° from one another about the same longitudinal axis. Such loops may be formed by simple electrical conductors. Alternatively, a first loop can be formed by a simple electrical conductor and the other helical loop can be formed half by a simple electrical conductor and half by a section of a transmission line comprising a pair of parallel conductors. Such section of transmission line can be simply a length of co-axial cable.

Figure 2:
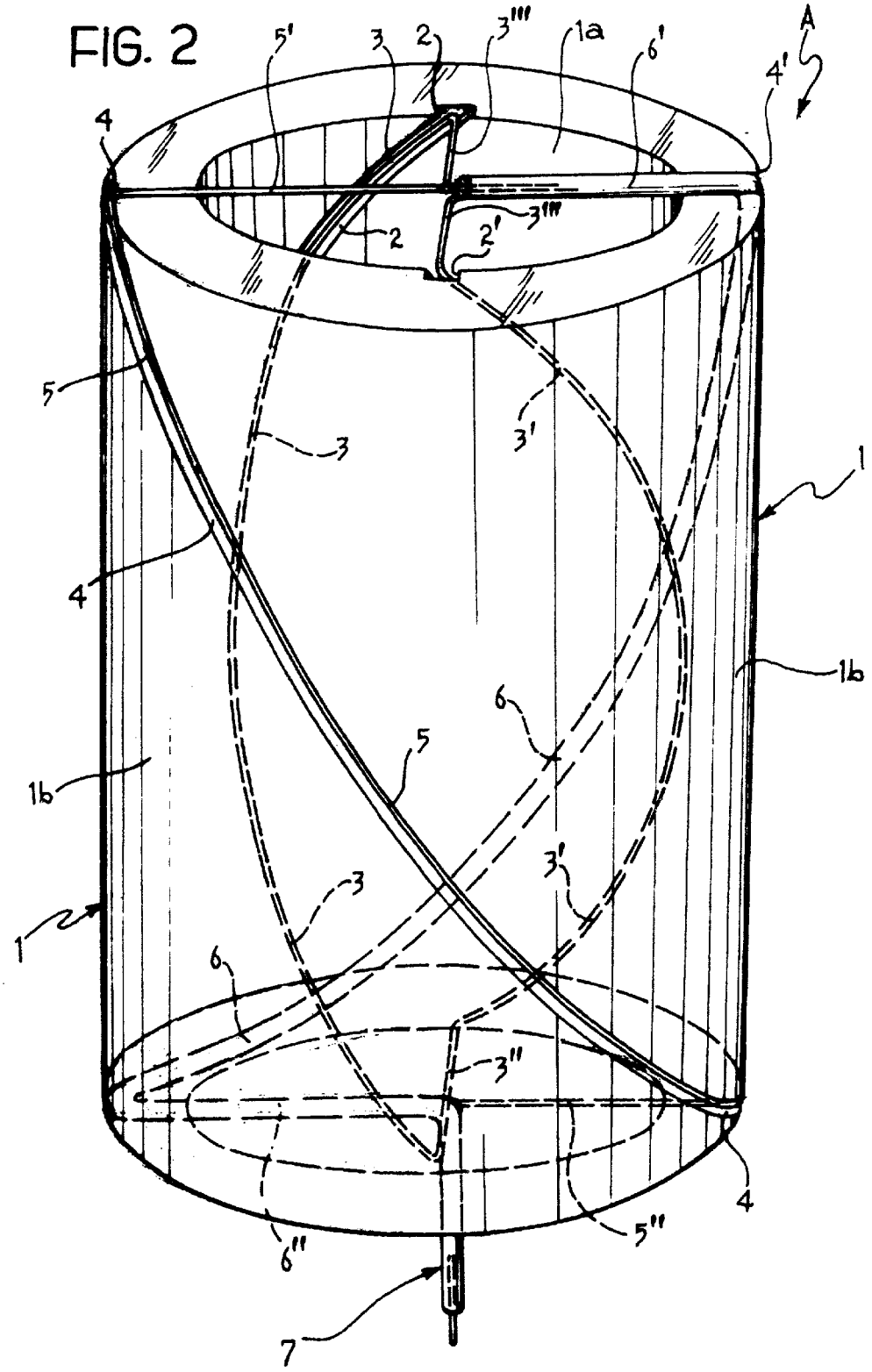
FIG. 2 is a perspective view of a first embodiment of a four-wire helical antenna according to the invention.

In a first embodiment, illustrated in FIG. 2, the antenna A comprises a support structure including a cylindrical tubular element 1 formed of dielectric material the walls of which carry the helicoidal sides of the said loops.

In particular, in the embodiment shown in FIG. 2, in the inner cylindrical surface 1*a* of the tubular element 1 are formed two helicoidal grooves, 2, 2', offset from one another by one half turn. In each of these grooves are housed respective portions 3, 3' of a wire conductor. At the lower end of the tubular element 1, the tubular portions 3, 3' of this conductor are interconnected by a further diameteral portion 3" of this wire conductor. At the opposite end of the tubular element 1, the helicoidal portions 3, 3' of the said wire conductor join with respective opposed radial portions 3'", which extend in the direction of the axis of this tubular element.

The wire conductor described above forms a first half turn of the helical loop.

The antenna A includes a second twin wire half turn helical loop. This second loop is formed half by lengths of simple electric conductive wire and half by a section of co-axial cable.

In the outer cylindrical surface 1*b* of the tubular element 1 are formed two helicoidal grooves 4, 4' offset from one another by one half turn and offset by one-quarter of a turn with respect to the internal grooves 2, 2'. The pitch of the helix of the grooves 4, 4' is essentially the same as that of the grooves 2, 2'.

In the groove 4 of the tubular element 1 is located a portion 5 of a simple conductive wire the lengths of which join with radial portions 5', 5", directed essentially in an orthogonal direction with respect to the portions 3", 3'" of the first loop.

In the groove 4' of the tubular element 1 lies a portion 6 of a length of co-axial cable. The ends of this portion extend in two radial portions of co-axial cable 6' and 6" essentially aligned with the corresponding portions 5', 5" of the associated simple wire conductor.

At the upper end of the antenna A the portion 5' of wire conductor is interconnected (for example by soldering) with a portion of the wire conductor 3'" and with the core of the portion of the co-axial cable 6'. The braiding (screen) of this portion of co-axial cable 6' is on the other hand connected to the other portion of wire conductor 3'".

At the lower end of the tubular element 1 the conductive wire portion 5" is connected, for example by soldering, to the braiding of the portion of the co-axial cable 6", and this latter extends into a portion 7 of a co-axial cable which represents the connection line of the antenna A to the circuits for processing the detected signals.

Figure 3:
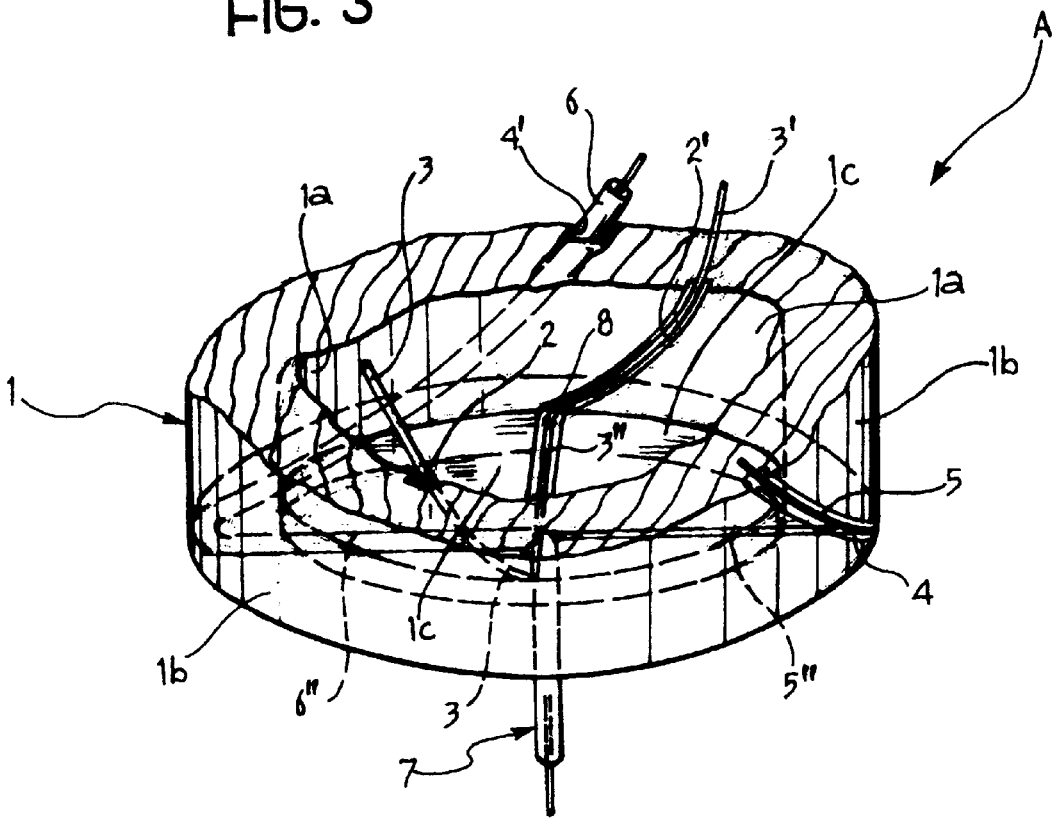
FIG. 3 is a partial perspective view which shows the lower part of the antenna illustrated in FIG. 2.

In FIG. 3 there is shown a lower part of an antenna A formed as a variant embodiment. In this variant the cylindrical tubular element 1 has its lower end closed by a bottom wall 1*c* so that essentially it is generally cup shape. On its inner face the bottom wall 1*c* has an essentially diametral groove 8 which joins with the grooves 2, 2' of the cylindrical wall of the tubular element 1 and in which the portion 3" of the wire conductor which forms the said first loop is housed.

On the outer face of the bottom wall 1*c* the tubular element 1 has two grooves in which lie portions 5" and 6" of the wire conductor and, respectively, of the coaxial cable, which forms the second loop.

Figure 4:
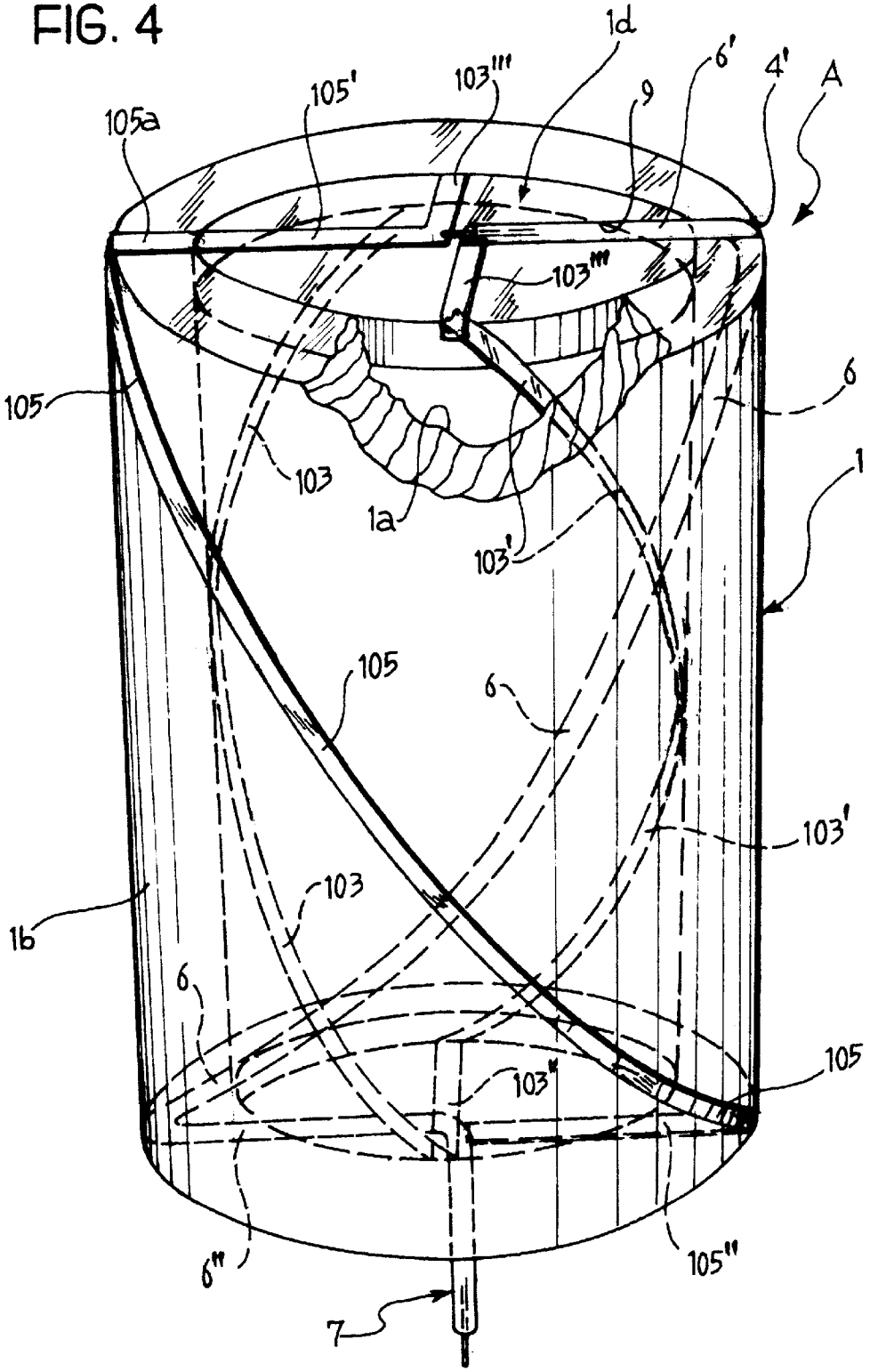
FIG. 4 is a partially sectioned perspective view of another embodiment of a four-wire helical antenna according to the invention.

In FIG. 4 is shown a further embodiment of an antenna A according to the invention, in which the said two helical loops are metal tracks formed, for example, by the printed circuit technique rather than wire conductors.

Figure 6:
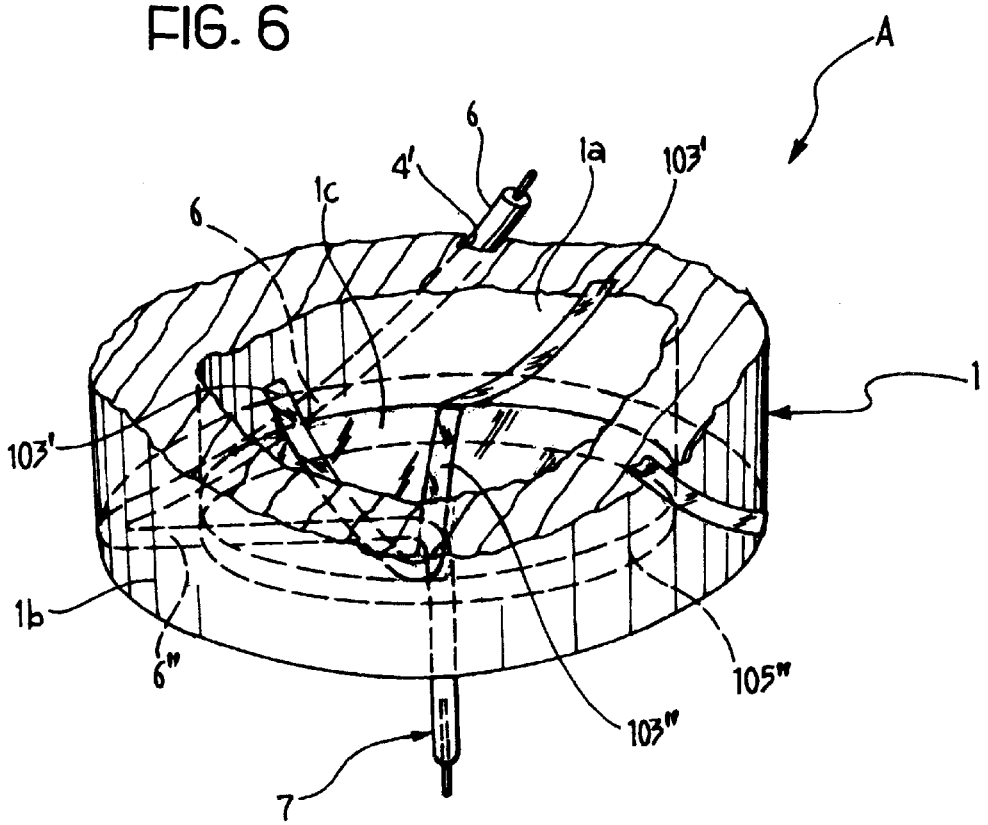
FIG. 6 is a partial perspective view which shows the lower portion of the antenna of FIG. 4.

The support structure for the antenna A of FIG. 4 also includes a cylindrical tubular element 1 the lower end of which is closed by a bottom wall 1*c* as shown in FIG. 6 similar to the preceding embodiment described with reference to FIG. 3.

Figure 5:
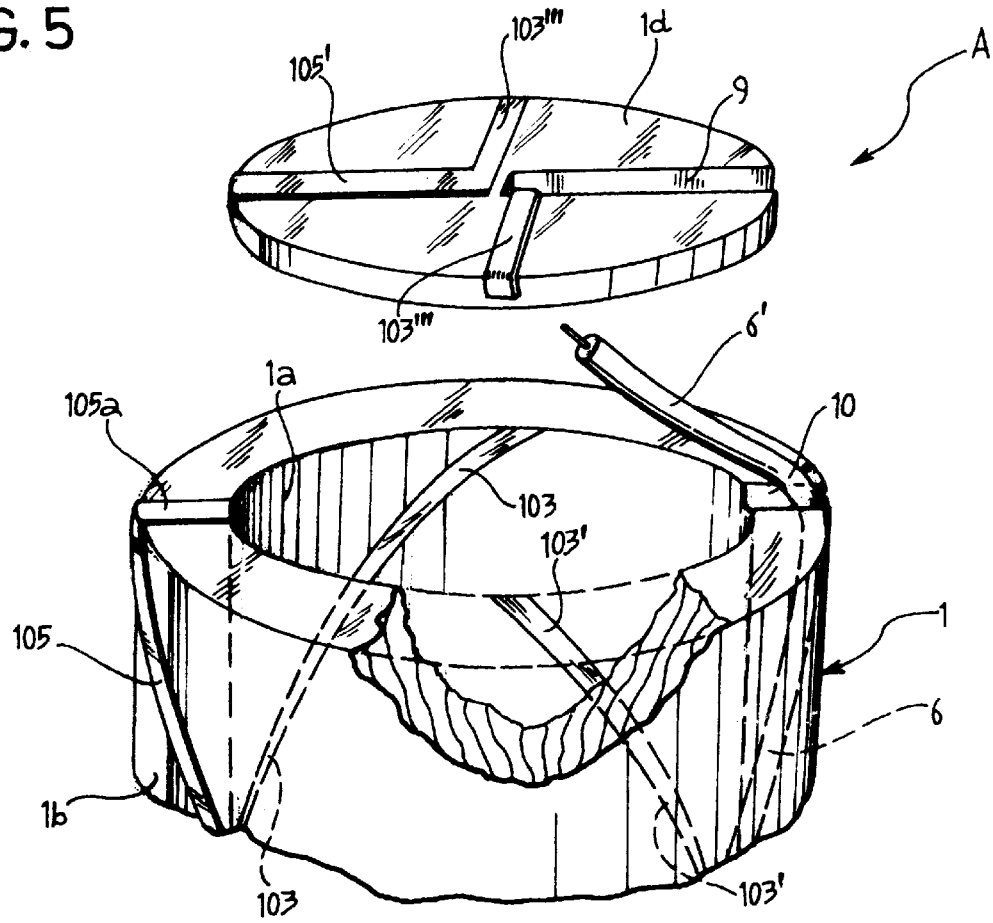
FIG. 5 is a partly sectioned exploded perspective view which shows the upper portion of the antenna of FIG. 4.

The upper end of the cylindrical tubular element 1 is closed by a disc 1*d* of dielectric material as seen in FIGS. 4 and 5.

A first twin wire helical loop is integrally formed by metal tracks applied to the tubular element 1, to its bottom wall 1*c* and to the disc 1*d*. In particular, this first loop comprises two tracks 103, 103' of helical form applied to the inner surface 1*a* of the tubular element 1 and offset from one another by one half turn. The lower ends of these tracks are joined by a diametral track 103" applied to the inner face of the bottom wall 1*c* of the tubular element 1 (see in particular FIG. 6).

The upper ends of the helical tracks 103, 103' are connected to the ends of two radial tracks 103'" applied to the disc 1*d* (FIGS. 4 and 5). The connection between the tracks 103, 103' and the tracks 103'" is conveniently stabilised by means of soldering.

The second loop of the antenna A of FIGS. 4 to 6 is, as previously mentioned, formed in part with metal tracks carried by the structure 1, 1*d* and in part by a length of co-axial cable also carried by this structure.

In particular, this second loop comprises a helical track 105 applied to the outer cylindrical surface 1*b* of the tubular element 1. This track is offset by one quarter of a turn with respect to the tracks 103, 103'.

The upper end of the helical tracks 105 extends into a radial track section 105*a* applied to the upper annular end face of the tubular element 1, which connect in turn to a radial track 105' applied to the upper face of the disc 1*d*. This radial track 105' joins with one of the tracks 103'" at the centre of the disc 1*d*. In particular, the track 105' can be made integrally with this track 103'".

The connection between the portion 105*a* and the radial track 105 of the disc 1*d* is conveniently stabilised by means of soldering.

The lower end of the helical track 105 extends into a radial track 105" applied to the outer face of the bottom wall 1*c* of the support element 1 (FIGS. 4 and 6).

The said second loop of the antenna according to FIGS. from 4 to 6 is completed by a length of co-axial cable a portion 6' of which lies in a radial groove 9 of the disc 1*d* and in a corresponding groove 10 in the upper end of the tubular element 1 (FIG. 5). This end portion 6' of the co-axial cable has its core soldered to the region in which the track 105' joins with one of the tracks 103'" and the outer screen or braiding connected to the other track 103'". The said section of co-axial cable includes an intermediate portion 6 which is housed in a groove 4' formed in the outer cylindrical surface 1*b* of the cylindrical tubular element 1 (FIG. 6), and which extends at the bottom into a radial section 6" lodged in a corresponding groove formed in the outer face of the bottom wall 1*c*. At the centre of this face of the bottom wall the braiding or screen of the co-axial cable is connected, for example by soldering, to the conductive track 105".

In another variant embodiment, not illustrated in the drawings, the section of co-axial cable of the antenna according to FIGS. 4 to 6 can be replaced by a transmission line of controlled impedance, comprising two parallel metal tracks applied to the inner and outer surfaces of the upper disc id, the cylindrical wall of the tubular element 1 and the bottom wall 1*c* of this tubular element.

In this embodiment, as in the embodiments previously described with reference to FIGS. 4 to 6, the various conductive tracks may be possibly formed not directly on the structure 1, 1*d*, 1*c* but on flexible supporting substrates such as plastics films, which can be applied to this support structure.

Figure 7:
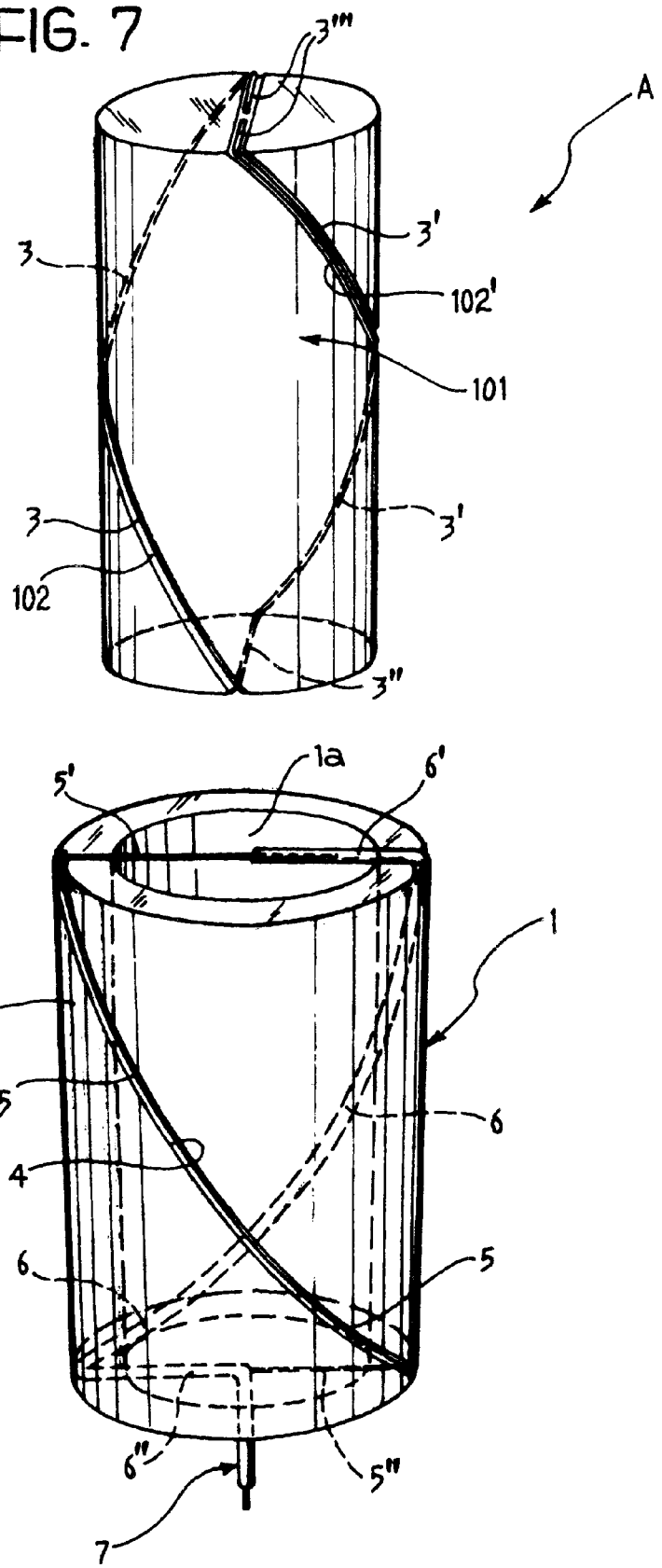
FIG. 7 is an exploded perspective view of a further embodiment of a four-wire helical antenna according to the invention.

A further variant embodiment is shown in FIG. 7. In this Figure, too, the same reference numerals have been allocated to parts and elements which have been already described.

In the embodiment of FIG. 7 the antenna A comprises a support structure including a cylindrical tubular element 1 of dielectric material which carries a twin wire helical loop formed in part by a section of co-axial cable (the portions of which are indicated 6', 6, 6") and in part by a simple wire conductor (the parts of which are indicated 5', 5, 5"). This loop is essentially identical to the corresponding loop of the version of FIG. 2.

In the antenna according to FIG. 7 the second twin wire helical loop is formed on a cylinder 101 of dielectric material disposed within the tubular element 1. The loop carried by this cylinder 101 is formed with a simple wire conductor the successive portions of which are thus, as in the variant of FIG. 2, indicated 3''', 3, 3'', 3', 3'''. The helical portions of this wire conductor lie in helical grooves 102, 102' correspondingly formed in the lateral surface of the cylinder 101. The radial portions 3''' and the diametrical portion 3'' of this loop lie in corresponding grooves formed in the flat end surfaces of the said cylinder.

The way in which the two loops described above are interconnected is the same as in the antenna of FIG. 2.

In a further embodiment, not shown in the drawings, the support structure for the antenna A comprises, as in the version according to FIG. 7, a tubular element and a cylinder positioned within this tubular element. The two twin wire helical loops are however formed of metal tracks applied to the surfaces of this tubular element and the associated cylinder similar to the version described above with reference to FIGS. 4 to 6.

This variant, as in the variant of FIG. 7, has the advantage of a greater practicality of construction of the two loops in that in order to position them it is necessary to operate preliminarily on the outer surfaces of the elements constituting the support structure of the antenna.

Naturally, the principle of the invention remaining the same, the embodiments and details of construction can be widely varied with respect to what has been described and illustrated purely by way of non-limitative example, without by this departing from the ambit of the invention as defined in the annexed claims.

In particular, in all the previously described embodiments, the two loops of the four-wire helical antenna can be formed with simple conductors of wire type or of the type formed with conductive tracks. In this case the balanced-unbalanced transformation would not be formed. The antenna thus formed must therefore be supplied with a suitable external device which achieves the action of a so-called balun and ensures the supply of the two helical loops with the necessary phase variation.

Moreover, in a further variant embodiment not illustrated, the cylindrical tubular element and/or the possible associated cylinder can be moulded over the elements constituting the two twin wire helical loops.

What is claimed is:

1. A device for the reception of position signals from a GPS system, on board a motor vehicle, comprising an antenna mounted within an external rear view mirror of the motor vehicle, wherein the antenna is a four-wire helical antenna, wherein the antenna comprises two half turn helical loops disposed at 90° to one another about a common longitudinal axis, and wherein a first helical loop is formed by a simple electrical conductor, and the a second helical loop is formed half by a simple electrical conductor and half by a section of transmission line comprising a pair of parallel conductors.

2. A device according to claim 1, wherein the ends of said first helical loop are each connected to a respective conductor of said transmission line at one end of said transmission line.

3. A device according to claim 1, in which the simple conductor which forms one half of said second loop has an end connected to the end of a conductor of said transmission line, and the other end connected to the opposite end of the other conductor of said transmission line.

4. A device according to claim 1, wherein said section of transmission line is a length of co-axial cable.

5. A device according to claim 1, wherein said antenna comprises a support structure including a cylindrical tubular element of dielectric material having a wall which carries the helical sides of said loops.

6. A device according to claim 5, in which helical grooves are formed in inner and outer cylindrical surfaces of said tubular element, in which grooves lie the helical sides of said loops.

7. A device according to claim 6, in which said cylindrical tubular element has an end closed by a bottom wall such that the cylindrical tubular element has an essentially cup-shape form; said bottom wall having on inner and outer faces thereof respective grooves in which lie rectilinear sides or branches of said loops.

8. A device according to claim 5, in which said loops are in part constituted by metal tracks applied to outer and inner cylindrical surfaces of said cylindrical tubular element.

9. A device according to claim 8, in which said tubular element has an end closed by a bottom wall such that said tubular element has an essentially cup-shape form and said loops are in part constituted by metal tracks applied to inner and outer faces of said bottom wall.

10. A device according to claim 9, in which said section of transmission line further includes two parallel conductive tracks applied to the inner and outer faces respectively of the said bottom wall.

11. A device according to claim 9, in which the other end of the tubular element is closed by a disc of dielectric material and said loops are in part constituted by metal tracks applied to said disc.

12. A device according to claim 11, in which said section of transmission line further includes two parallel conductive tracks applied to inner and outer faces respectively of said disc.

13. A device according to claim 8, in which said section of transmission line comprise two parallel conductive tracks applied to the inner cylindrical surface and the outer cylindrical surface respectively of said cylindrical tubular element.

14. A device according to claim 5, in which said section of transmission line is a length of co-axial cable which lies partly in a helical groove of the cylindrical tubular element.

15. A device according to claim 5, in which said cylindrical tubular element is moulded over the helical sides of said loops.

16. A device according to claim 1, in which said antenna comprises a support structure including a cylindrical tubular element of dielectric material a wall of which carries helical sides of one loop, and an inner cylinder also of dielectric material, which is disposed within said tubular element and which carries helical sides of the other loop.

17. A device according to claim 16, in which in the outer cylindrical surface of the tubular element and of the inner cylinder respectively are formed respective helical grooves in which lie the helical sides of said one loop and said other loop respectively.

18. A device according to claim 16, in which said loops are in part constituted by conductive tracks applied to the outer cylindrical surface of the tubular element and of the inner cylinder respectively.

19. A device according to claim 16, in which said cylindrical tubular element and the inner cylinder are moulded over the helical sides of said loops respectively.

* * * * *